US008170267B2

(12) United States Patent
Kim et al.

(10) Patent No.: US 8,170,267 B2
(45) **Date of Patent: *May 1, 2012**

(54) SPEAKER

(75) Inventors: Hee Jin Kim, Daegu (KR); Young In Ko, Gyeongsang-bukdo (KR)

(73) Assignee: LG Electronics Inc., Seoul (KR)

( * ) Notice: Subject to any disclaimer, the term of this patent is extended or adjusted under 35 U.S.C. 154(b) by 610 days.

This patent is subject to a terminal disclaimer.

(21) Appl. No.: 12/304,481

(22) PCT Filed: Jan. 4, 2007

(86) PCT No.: PCT/KR2007/000052

§ 371 (c)(1),
(2), (4) Date: Dec. 12, 2008

(87) PCT Pub. No.: WO2008/001995

PCT Pub. Date: Jan. 3, 2008

(65) Prior Publication Data

US 2009/0262960 A1 Oct. 22, 2009

(30) Foreign Application Priority Data

Jun. 29, 2006 (KR) ..... 10-2006-0059204

(51) Int. Cl.
*H04R 1/00* (2006.01)

(52) U.S. Cl. ..... 381/396; 381/400; 381/412; 381/420; 381/431

(58) Field of Classification Search ..... 381/396, 381/398, 400, 412, 420, 431
See application file for complete search history.

(56) References Cited

U.S. PATENT DOCUMENTS 6,118,884 A * 9/2000 Proni ..... 381/403
2004/0218779 A1* 11/2004 Fukuyama et al. ..... 381/409

FOREIGN PATENT DOCUMENTS

| | | | |
|---|---|---|---|
| JP | 55-115798 | A | 9/1980 |
| JP | 08-265895 | A | 10/1996 |
| JP | 10-341499 | A | 12/1998 |
| KR | 10-2001-0046014 | A | 6/2001 |
| KR | 10-2001-0058096 | A | 7/2001 |
| KR | 10-2003-0008844 | A | 1/2003 |

OTHER PUBLICATIONS

International PCT Search Report dated Jun. 14, 2007.
Korean Decision to Grant a Patent dated Jan. 8, 2009 for Application No. 10-2006-0059204.
PCT International Search Report and Written Opinion dated Jun. 14, 2007 for Application No. PCT/KR2007-000052.

* cited by examiner

*Primary Examiner* — Wai Sing Louie
(74) *Attorney, Agent, or Firm* — KED & Associates LLP

(57) ABSTRACT

A speaker is disclosed. A speaker includes a fixing part (500) fastened to a base frame; a motion part moved (400) with respect to the fixing part by an electromagnetic force; a vibration plate (200) that vibrates in communication with the motion part; and a guide member (800) provided between the motion part (400) and the vibration plate (200). Therefore, according to the present invention, a speaker capable of reproducing a high quality sound and high power with a slim design may be embodied.

16 Claims, 5 Drawing Sheets

[Fig. 1]
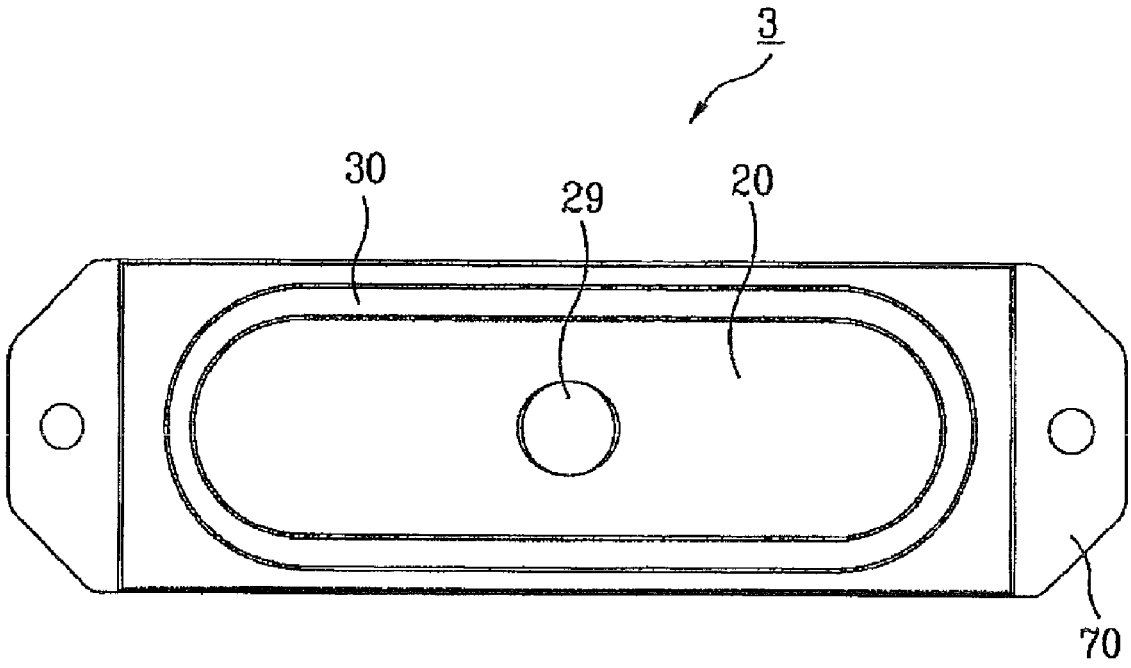

[Fig. 2]
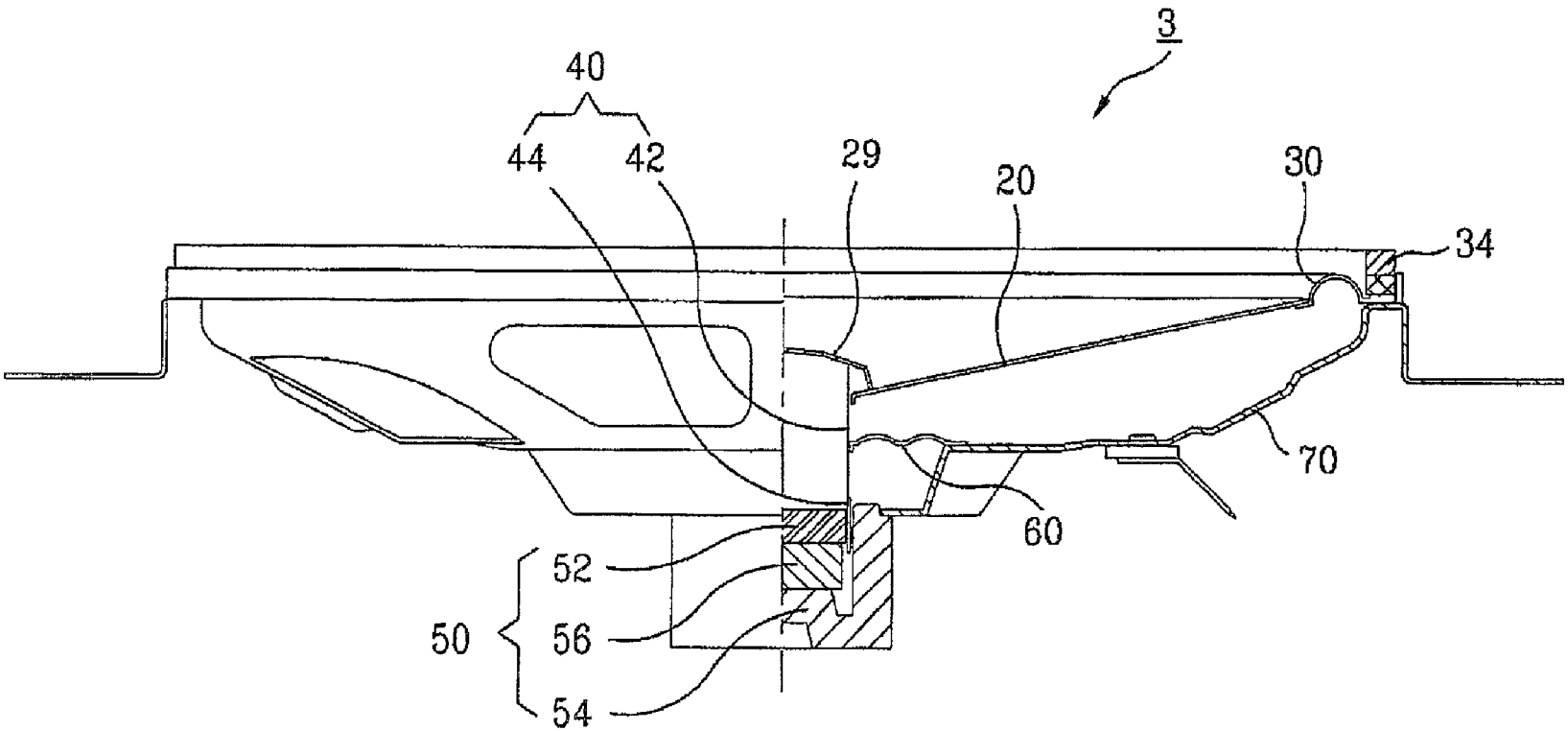

[Fig. 3]
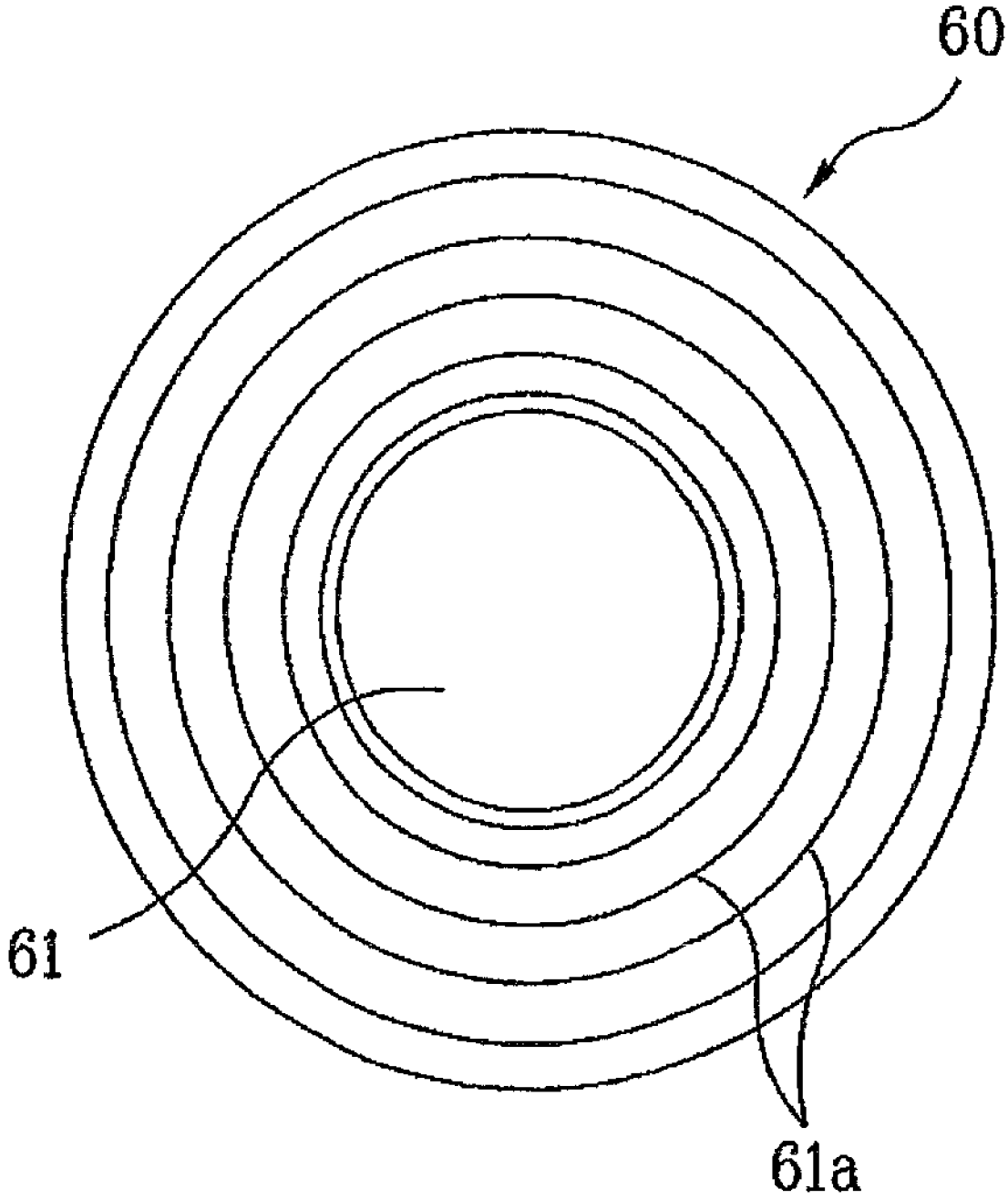

[Fig. 4]
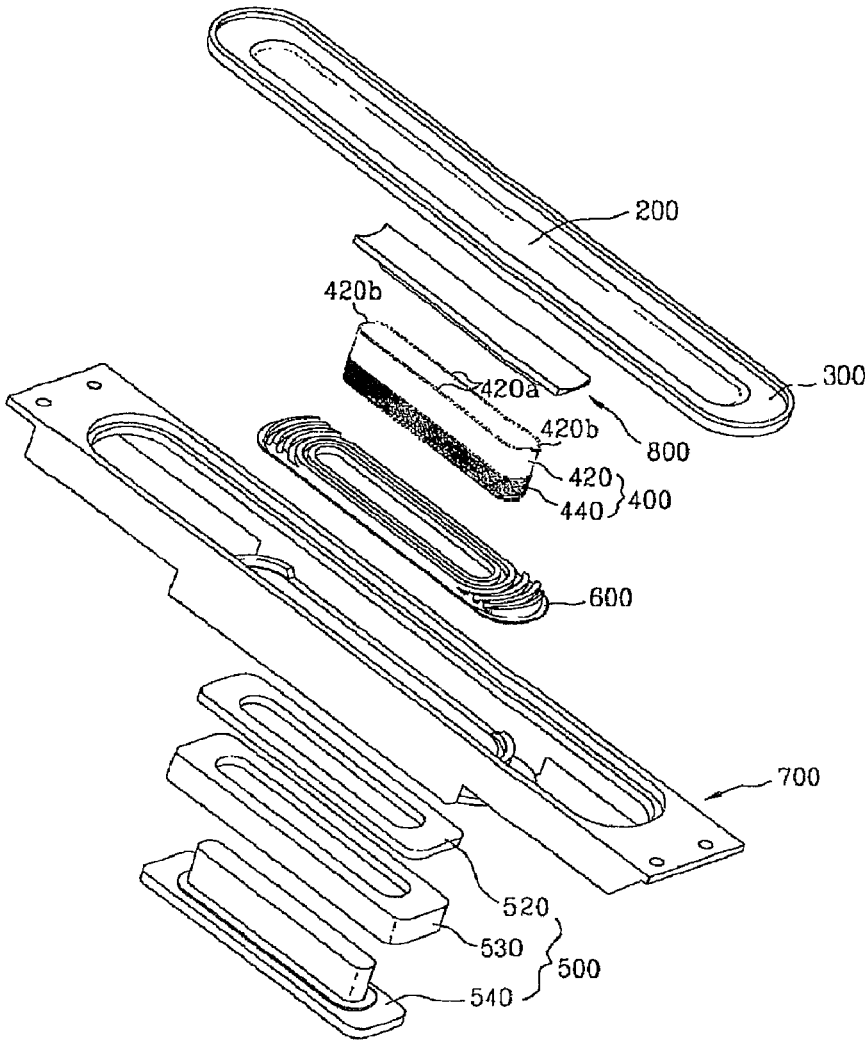
[Fig. 5]
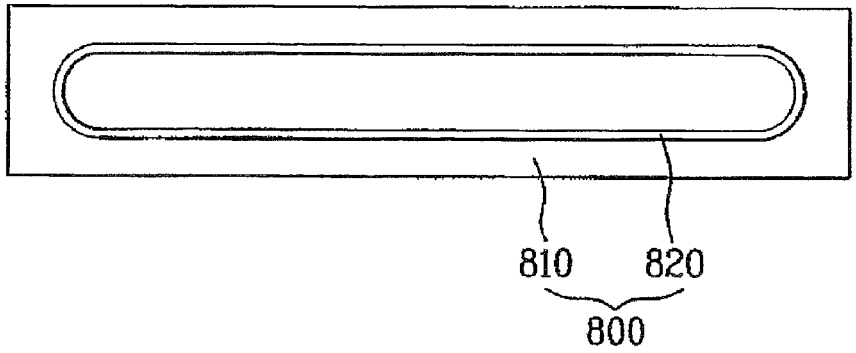

[Fig. 6]
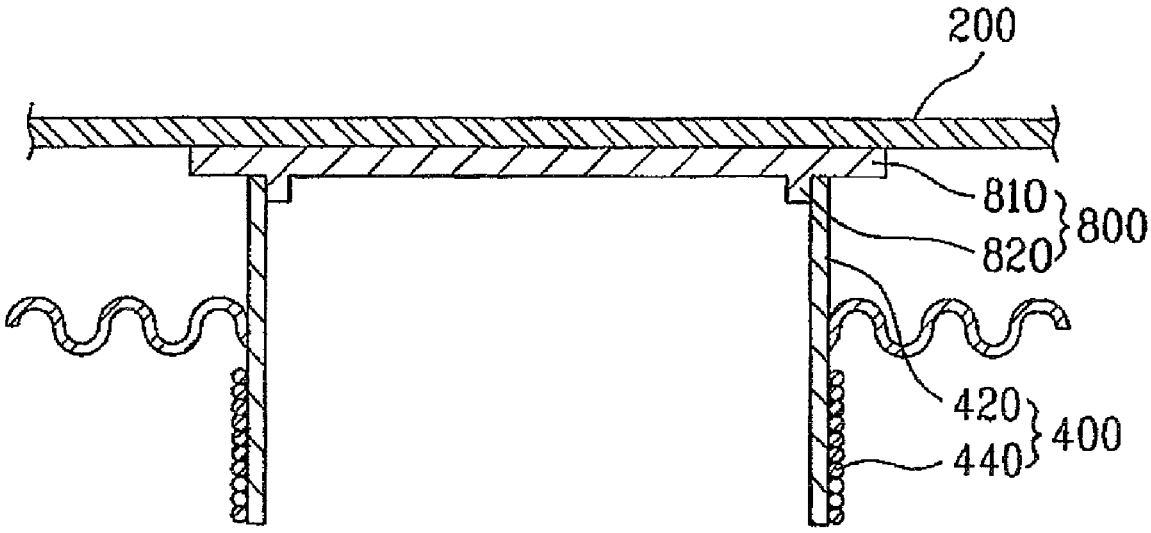

SPEAKER

TECHNICAL FIELD

The present invention relates to a speaker, and more particularly, to a speaker adaptable to a display apparatus such as a TV and a computer monitor.

BACKGROUND ART

Generally, a speaker converts electrical signals to vibration of a vibration plate and creates waves in the air to generate an acoustic wave. That is, a speaker is a kind of a conversion device which converts electrical signals to an acoustic energy. A speaker includes vibration parts such as a vibration plate, support parts such as a damper, magnetic parts such as a magnet. A speaker may be classified into various categories based on a vibration plate position, a vibration plate shape, a principle/method for converting electrical signals to acoustic waves or the like. Especially, a speaker adapted to a display apparatus such as TV or the like is usually a radiation type speaker having a vibration plate positioned in the air. In the radiation type speaker, electric currents corresponding to acoustic signals are flowing in a coil provided in a magnetic field formed by a magnet and then the coil vibrates based on the intensity of electric currents, which is a common principle of a speaker operation.

Recently, a large screen display apparatus has been used broadly due to development of a semiconductor technology. To present a beautiful and simple design of such a large screen display apparatus as a FPD (Flat Panel Display), a speaker has to be small and slim. If a speaker is small, inner parts such as a vibration part, a magnet part and a support part should be minimized as well. However, if a speaker is small, functions of a speaker may deteriorate. This is due to deterioration of sound radiation efficiency caused by reduction of a vibration part, especially effective vibration area, flux density reduction caused by reduction of a magnetic part and so on. However, in spite of a small size of a speaker, a speaker for a large screen display apparatus is required to have the same as or better function than a conventional speaker.

In a speaker adapted to a FPD, it is not relatively easy to adjust a width and thickness of a speaker, while it is relatively easy to adjust a length of a speaker. Thus, it is general to reduce the width/thickness and increase the length in order not to reduce an effective vibration area. That is, a speaker having a rectangular or an oval shape with a short width and long length (hereinafter, a trade type speaker) is used not to reduce a work vibration area. That is, the speaker for a FPD has a high ratio of a long diameter to a short diameter, or a ratio of the length to the width of a speaker.

Referring to FIGS. 1 and 2, a conventional track type speaker will be described.

A speaker 3 includes an energy conversion part 40 and 50 that converts an electrical energy (an electrical signal) to a kinetic energy, and a vibration plate 20 that converts the kinetic energy generated at the energy conversion part 40 and 50 to an acoustic energy.

The energy conversion part 40 and 50 includes a fixing part 50 and a motion part 40 relatively moved with respect to the fixing part 50 by an electromagnetic force. The vibration plate 20 is connected to the motion part 40 to reproduce a sound by using the vibration of the vibration plate 20.

More specifically, the fixing part 50 is provided at a predetermined portion of a base frame 70. The fixing part 50 includes a permanent magnet 56. Commonly, an upper plate 52 and a lower plate 54 are provided on an upper portion and lower portion of the permanent magnet 56, respectively to concentrate a magnetic flux generated at the permanent magnet 56 there between. The motion part 40 is generally called as a voice coil assembly, which includes a bobbin 42 having a cylindrical shape and a voice coil 44 wound around the bobbin 42. The vibration plate 20 is connected to the bobbin 42. A center cap 29 is provided on a center of the vibration plate 20. The numeral reference 34 is a gasket.

A lower portion of the bobbin 42 is elastically connected to the base frame 70 by a damper 60. The vibration plate 20 is connected to an upper portion of the bobbin 42 and an outer end of the vibration plate 20 is connected to the base frame 70 by an elastic support part 30 (hereinafter, an edge). The damper 60 and the edge 30 are kinds of the supporting parts, which supports the vibration part including the voice coil 44, the bobbin 42 and the vibration plate 20 in their appropriate position to perform a vertical motion, in other words, a piston motion. Also, the damper 42 and the vibration plate 20 affects reproduction of high power and high quality sound.

As mentioned above, the trade type speaker 3 is shaped with a narrow width and a long length. The vibration plate 20 has a large ratio of a length to a width. However, the section of the bobbin 42 has a circular shape. Also, the shape of the damper corresponds to the shape of the bobbin and thus is circular, more specifically, annular. As shown in FIG. 3, the damper 60 elastically supporting the bobbin 42 has a ring shape and is repeatedly curved a predetermined distance in a circumferential direction from a hollow part 61. That is, the damper 60 has a plurality of wrinkle parts 61*a* in approximately concentric circle shape.

Referring to FIG. 2, an operation of the track type speaker will be described as follows.

Once electric currents are applied to the voice coil 44, an inductive force is generated at the coil within the magnetic field of the permanent magnet 56. Hence, the voice coil 44 moves vertically and the bobbin 42 connected to the voice coil 44 moves vertically. Accordingly, the vibration plate 20 coupled to the bobbin 42 also vertically moves in communication with the vertical motion of the voice coil 44, which is an upward/downward piston motion. That is, the vibration plate 20 vibrates forwardly/backwardly in communication with the voice coil 44 and the bobbin 42 to vibrate air, such that acoustic waves may be generated. The sound applied to the voice coil 44 as an electrical signal is substantially reproduced by the vibration of the vibration plate 20 to radiate outside of the speaker.

DISCLOSURE OF INVENTION

Technical Problem

The conventional track type speaker described above has following problems.

First, the conventional track type speaker has a problem that it is limited to enlarge its effective vibration area due to its structure. Moreover, the width of the conventional track type speaker is reduced and thus the sizes of the voice coil and damper are reduced. Thus, it is difficult for the conventional trade type speaker to endure the inputted high voltage. As a result, it is difficult to achieve high quality sound and high power.

Next, according to the conventional trade type speaker, the width of the vibration plate is smaller than the length of the vibration plate. Not the whole portion of the vibration plate, the center of the vibration plate is supported by the damper. Thereby, there may be an unbalanced vibration in a longitudinal direction. Also, the vibration plate may be unbalancedly supported by the voice coil and the damper. Accordingly, resonance of the vibration may be generated, which might distort reproduced sound due to a non-linear motion of the vibration parts. Still further, there may be a strange sound or damage of the parts due to the mechanical friction.

Technical Solution

An object of the present invention is to provide a speaker which can be slim with preventing sound reproduction deterioration To achieve these objects and other advantages and in accordance with the purpose of the invention, as embodied and broadly described herein, a speaker includes a fixing part fastened to a base frame; a motion part moved with respect to the fixing part by an electromagnetic force; a vibration plate that vibrates in communication with the motion part; and a guide member provided between the motion part and the vibration plate. The vibration plate may be formed in a trade shape and the shape of the motion part may be corresponding to the shape of the vibration plate. Also, the speaker according to the present invention further includes a damper to support the motion part and the damper is provided in a track shape.

Here, the guide member includes an upper member fastened to the vibration plate and a lower member fastened to the motion part. The upper member is substantially formed in a plate shape and the lower member is formed in a shape corresponding to a sectional shape of the motion part. Also, the lower member is connected to at least one of an outer and inner surface of the motion part.

In another aspect of the present invention, a speaker includes a fixing part fixed to a base frame; a motion part moved with respect to the fixing part by an electromagnetic force; a vibration plate that vibrates in communication with the motion part; and a reinforcement member that reinforces an upper portion of the motion part. Here, the vibration plate and the motion part are formed in a track shape.

Therefore, according to the present invention, a speaker capable of reproducing a high quality sound and high power with a slim design may be embodied.

Advantageous Effects

A speaker according to the present invention has an advantageous effect that it is possible to present a high quality sound/high power, with a slim design.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a front view of a conventional trade type speaker;

FIG. 2 is a sectional view of FIG. 1;

FIG. 3 is a plane view illustrating a damper of FIG. 1;

FIG. 4 is an exploded perspective view illustrating an embodiment of a track type speaker according to the present invention;

FIG. 5 is a diagram illustrating a guide member of FIG. 4 seen from a lower portion; and FIG. 6 is a longitudinal sectional view of FIG. 4.

BEST MODE FOR CARRYING OUT THE INVENTION

Reference will now be made in detail to the preferred embodiments of the present invention, examples of which are illustrated in the accompanying drawings.

Referring to FIG. 4, a preferred embodiment of a speaker according to the present invention will be described.

Similar to the prior art, the speaker according to the present invention includes an energy conversion part 400 and 500, and a vibration plate 200. The fixing part 500 includes a permanent magnet 560. Preferably, the fixing part 500 further includes an upper plate 520 and a lower plate 540. Also, an auxiliary magnet (not shown) may be provided in the fixing part 500 for concentrating the magnetic force. The motion part 400 includes a bobbin 420 and a voice coil 440. The bobbin 420 is supported by a damper 600 and the vibration plate 200 is supported by an edge 300.

Corresponding to the trade shaped vibration plate 200, the motion part 400 and the damper 600 are trade shaped. Furthermore, a guide member 800 is provided between the motion part 400 and the vibration plate 200.

When the vibration plate 200 has a track shape, it is preferred that the motion part 400 also has a track shape. If a conventional circular shaped motion part such as a circular bobbin is provided in the trade shaped vibration plate 200, the motion part 400 is connected to a center of the track shaped vibration plate 200 which may cause a resonance mode of the vibration plate 200. Thereby, in the track shaped vibration plate with a circular shaped motion part, unintended vibration may occur and also a driving force for vibrating the vibration plate may decrease.

Meanwhile, if the motion part 400 is track shaped, a width part 420*a* of the motion part 400 could be distorted and then it is difficult to actually embody the track shaped motion part 400. The thickness of the motion part 400, especially the thickness of the bobbin 420, is thin. Thereby, the width part 420*a* of the bobbin 420 may be distorted by the operation and inner heat of the speaker. Accordingly, the motion part 400 and the vibration plate 200 are connected via the guide member 800 to prevent the motion part 400 from being distorted. Also, the guide member 800 is used to enlarge a contact area between the motion part 400 and the vibration plate 200.

More specifically, an inner portion of the damper 600 is connected to the bobbin 4 20 and an outer portion of the damper 600 is connected to the base frame 700. A wrinkle part is formed on a length-part 420*b* of the damper 600. The vibration plate 200 is provided in an approximate upper portion of the bobbin 420 to vibrate in communication with the bobbin 420 and the vibration plate 200 is connected to the bobbin 420 via the guide member 800.

Referring to FIGS. 5 and 6, the guide member 800 will be described in detail as follows.

The guide member 800 includes an upper member 810 fastened to the vibration plate 200 and a lower member 820 connected to the upper member 810 to be fastened to the bobbin 420.

Since the upper member 810 is fastened to the vibration plate 200, an upper surface of the upper member 810 has a shape corresponding to a back surface of the vibration plate 200, which is preferably formed in a plate shape. Preferably, the entire size of the upper member 810 is relatively large enough to cover at least an upper portion of the bobbin 420.

The lower member 820 is fastened to the bobbin 420 to prevent the bobbin 420 from being distorted. The shape of the lower member 820 is corresponding to a sectional shape of the lower member 820 in a horizontal direction. Preferably, the size of the lower member 820 is smaller than that of the bobbin 420 to be fastened to an inner surface of the bobbin 420 in close contact. The vertical length of the lower member 820 may be determined appropriately based on a range of the piston motion of the bobbin 420. The shape of the lower member 820 may be not limited and then may be variable if it can perform its reinforcement function to prevent the bobbin 420 from being distorted. For example, it is possible that the lower member 820 is fastened to at least one of an inner and outer wall of the bobbin 420.

The shape of the vibration plate 200 may not be limited to the above embodiment, and then may be variable such as a plate type, cone type or the like. Although the track shaped vibration plate 200 and bobbin 420 are shown and described in the above embodiment, the present invention may not be limited thereto, and may be adaptable in various ways. For example, even in case of a speaker having a track shaped vibration plate/a circular bobbin or a circular vibration plate/a circular bobbin, the guide member 800 may prevent the bobbin 420 from being distorted. Also, the guide member 800 may be used only to reinforce the bobbin 420. That is, only the lower member 820 mainly reinforcing the bobbin 420 is used as a reinforcement member.

Referring to the FIG. 4, an operation of the speaker according to the present invention will be described.

Once an electrical signal is applied to the voice coil 440, the voice coil 440 vertically moves, in other words, performs a piston motion in interrelation with the permanent magnet 560. Hence, the bobbin 420 connected to the voice coil 440 also vertically performs a piston motion and the vibration plate 200 connected to the bobbin 420 vertically performs a piston motion to vibrate.

At that time, it is possible to suppress an unnecessary vibration mode of the vibration plate 200. Sound reproduction efficiency, especially, base sound reproduction efficiency may be enhanced. Also, distortion of the bobbin 420 may be effectively prevented by the guide member 800, such that strange sound generated by the distortion of the bobbin 420 may be prevented.

As described in the embodiment, it is preferred that the speaker of the present invention is adapted to a display apparatus such as a TV, a computer, a monitor or the like and it is not limited thereto. Alternatively, the speaker of the present invention may be adapted to other various kinds of apparatus.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The industrial applicability of the present invention is described in the disclosure of the invention.

First, according to the present invention, an unnecessary vibration mode of the vibration plate may be suppressed. Thus, there is an industrial applicability that a high quality sound/high power speaker can be presented.

Furthermore, since a nonlinear vertical motion of the vibration parts caused by the difference between the length and width of track type speaker may be reduced in present invention, there is another industrial applicability that a high sound quality speaker can be presented.

Still further, there is a further industrial applicability that a supporting structure of a damper may be improved.

The invention claimed is:

1. A speaker comprising:

a fixing part fastened to a base frame;

a motion part that moves with respect to the fixing part by an electromagnetic force, the motion part including a bobbin and a voice coil wound around the bobbin;

a vibration plate that vibrates in communication with the motion part, the vibration plate being formed in a track shape; and a guide member provided between the motion part and the vibration plate, wherein a shape of the bobbin corresponds to a shape of the vibration plate, and wherein a portion of the guide member is positioned within the motion part to prevent a width part of the bobbin from being distorted.

2. The speaker as claimed in claim 1, further comprising a damper to support the motion part, the damper being provided in a track shape.

3. The speaker as claimed in claim 1, wherein the guide member comprises an upper member fastened to the vibration plate and a lower member fastened to the motion part.

4. The speaker as claimed in claim 3, wherein the upper member is substantially in a plate shape and the lower member is formed in a shape corresponding to a sectional shape of the motion part.

5. The speaker as claimed in claim 4, wherein the lower member is connected to at least one of an outer and inner surface of the motion part.

6. A speaker comprising:

a fixing part fixed to a base frame;

a motion part moved with respect to the fixing part by an electromagnetic force;

a vibration plate that vibrates in communication with the motion part; and a reinforcement member that reinforces an upper portion of the motion part.

7. The speaker as claimed in claim 6, wherein the vibration plate and the motion part are formed in a track shape.

8. A speaker comprising:

a fixing part;

a motion part to move with respect to the fixing part, the motion part including a bobbin and a voice coil around the bobbin;

a vibration plate to vibrate in communication with the motion part, the vibration plate being a track shape, and the bobbin being in a track shape; and a guide member provided between the motion part and the vibration plate, the guide member including a first member to couple to the vibration plate and a second member to couple to the motion part, and the second member of the guide member is positioned within the motion part to prevent a width of the bobbin from being distorted.

9. The speaker as claimed in claim 8, further comprising a damper to support the motion part, the damper being provided in a track shape.

10. The speaker as claimed in claim 8, wherein the first member of the guide member is a plate shape and the second member of the guide member is in a shape corresponding to a sectional shape of the motion part.

11. The speaker as claimed in claim 10, wherein the second member of the guide member is connected to an outer surface of the motion part or an inner surface of the motion part.

12. A speaker comprising:

a base frame;

a fixing part coupled to a base frame;

a motion part that moves with respect to the fixing part, the motion part including a track-shaped bobbin and a voice coil;

a track-shaped vibration plate to vibrate based on communication with the motion part; and a guide member provided between the motion part and the track-shaped vibration plate, wherein a lower portion of the guide member is provided within the motion part to reduce distortion of a width of the track-shaped bobbin.

13. The speaker as claimed in claim 12, further comprising a track-shaped damper to support the motion part.

14. The speaker as claimed in claim 12, wherein an upper portion of the guide member is coupled to the track-shaped vibration plate and the lower portion of the guide member is coupled to the motion part.

15. The speaker as claimed in claim 14, wherein the upper portion of the guide member is substantially in a plate shape and the lower portion of the guide member is formed in a shape corresponding to a sectional shape of the motion part.

16. The speaker as claimed in claim 15, wherein the lower portion of the guide member is connected to an outer surface of the motion part or an inner surface of the motion part.

* * * * *